US006318346B1

(12) United States Patent
Martin

(10) Patent No.: US 6,318,346 B1
(45) Date of Patent: Nov. 20, 2001

(54) SUPERCHARGER WITH NEW IMPELLER AND IMPROVED DRIVE ASSEMBLY

(76) Inventor: Allen L. Martin, 4624 E. Aire Libre, Phoenix, AZ (US) 85032

( * ) Notice: Subject to any disclaimer, the term of this patent is extended or adjusted under 35 U.S.C. 154(b) by 0 days.

(21) Appl. No.: 09/684,645

(22) Filed: Oct. 10, 2000

Related U.S. Application Data

(63) Continuation of application No. 09/185,898, filed on Nov. 4, 1998, now Pat. No. 6,129,510.

(51) Int. Cl.[7] ..... F02B 33/00
(52) U.S. Cl. ..... 123/559.1; 415/122.1
(58) Field of Search ..... 123/559.1; 415/122.1; 416/179

(56) References Cited

U.S. PATENT DOCUMENTS

| | | | | |
|---|---|---|---|---|
| 2,741,234 | | 4/1956 | Wiseman . | |
| 2,756,735 | | 7/1956 | Oehrli . | |
| 2,835,238 | | 5/1958 | Oehrli . | |
| 4,619,590 | | 10/1986 | Johnson . | |
| 4,998,524 | * | 3/1991 | Black et al. | 123/559.1 |
| 5,020,971 | | 6/1991 | Greenspan . | |
| 5,060,622 | | 10/1991 | Suzuki . | |
| 5,085,199 | | 2/1992 | Sado et al. . | |
| 5,197,427 | | 3/1993 | Masuda et al. . | |
| 5,224,459 | * | 7/1993 | Middlebrook | 123/559.1 |
| 5,392,751 | | 2/1995 | Matsubara et al. . | |
| 5,402,765 | | 4/1995 | Spinnler . | |
| 5,423,304 | | 6/1995 | Lawrence et al. . | |
| 5,425,345 | | 6/1995 | Lawrence et al. . | |
| 5,460,145 | | 10/1995 | Perry, Jr. . | |
| 5,785,493 | | 7/1998 | Ojima et al. . | |
| 5,887,576 | | 3/1999 | Wheeler, Jr. et al. . | |
| 6,082,340 | * | 7/2000 | Heimark | 123/559.1 |
| 6,129,510 | * | 10/2000 | Martin | 415/124.2 |

FOREIGN PATENT DOCUMENTS 405272494 10/1993 (JP) .

OTHER PUBLICATIONS

Robert H. Creamer, Machine Design, Second Edition, 1976 pp. 113–115 (Temple University).

* cited by examiner

*Primary Examiner*—Hoang Nguyen
(74) *Attorney, Agent, or Firm*—Ellis, Venable & Busam

(57) ABSTRACT

An impeller for a supercharger is described. The impeller comprises a body having a base and an air intake end wherein the body is adapted to mount to a drive assembly of the supercharger. Further, the drive assembly is able to drive and rotate the body. Precision made air vanes are attached to the body wherein the precision made air vanes and the body are able to be positioned within a volute chamber housing creating precision sealing gaps.

19 Claims, 6 Drawing Sheets

SUPERCHARGER WITH NEW IMPELLER AND IMPROVED DRIVE ASSEMBLY

The present invention is a continuation of U.S. patent application Ser. No. 09/185,898, filed Nov. 4, 1998, now U.S. Pat. No. 6,129,510.

FIELD OF THE INVENTION

The present invention relates to an improved mechanically driven centrifugal air compressor or supercharger (hereafter collectively referred to as "supercharger"), and in particular, to an improved supercharger having a new impeller and an improved drive assembly.

BACKGROUND OF INVENTION AND BRIEF DESCRIPTION OF THE PRIOR ART

A mechanically driven centrifugal air compressor or supercharger is typically mounted to an internal combustion engine or drive source at a location that is remote from the engine's crankshaft. Compressors or superchargers typically have an impeller, a volute chamber housing, and a drive configuration. These compressors or superchargers are mounted to a drive source or engine in order to increase the performance of the drive source or engine by forcing more air into the combustion chambers of the drive source or engine. Since conventional impellers for superchargers are typically not very efficient for processing air, then these conventional impellers for prior art superchargers need to be operated at relatively higher speeds (RPMs) to achieve as constant of an output air pressure over a wide speed range for the engine or drive source as possible. However, the pressure of the outputted air for these conventional superchargers achieved over the wide speed range is still not very constant (i.e. may fluctuate dramatically) or is not very good.

The mechanical drive between the crankshaft and the supercharger is typically provided by a drive belt and pulley configuration wherein a generally smaller supercharger pulley is overdriven by a generally larger crankshaft pulley. However, the initial overdrive speed ratio that is derived from the primary drive configuration (i.e. drive belt and pulley configuration) is not sufficient to drive the impeller at a high enough speed for a more constant air pressure output. Therefore, gear up configurations or secondary overdrive components are provided by superchargers to further increase the speed of the impeller. Typically, an additional gear driven (i.e. gear to gear configuration) overdrive assembly is provided within the supercharger housing to further increase or step up the output speed of the impeller. U.S. Pat. Nos. 2,741,234, 5,423,304, and 5,425,345 disclose examples of such gear to gear step up configurations for superchargers. These prior art patents are incorporated by reference herein.

For example, conventional superchargers may require the impeller to be overdriven at a relatively high ratio in order to reach rotational impeller speeds in excess of 65,000 RPM. The reason the supercharger is operated at such high speeds is because of the inefficient prior art impeller designs. Also, air sealing at the gap between the impeller and the volute chamber housing needs to exist for more optimal operation of the supercharger. Typically, conventional impellers are positioned between a gap of 0.015 to 0.017 inch from the air sealing area of the volute chamber housing, and therefore, these impellers need to be rotated and driven at high speeds in order to provide a tighter air seal between it and the air sealing area of the volute chamber housing. Furthermore, the prior art superchargers are not machined with high tolerances to provide for precision positioning between its parts, and it is therefore needed and desired to provide a supercharger that has precision made and/or high tolerance parts. It is also very much needed and desired to provide and use more precisely made and positioned supercharger parts having higher tolerances in order to achieve better air sealing at the gap, especially if the impeller is to be rotated and driven at relatively lower speeds.

However, other various problems and disadvantages exist with these prior art superchargers, impellers, and gear up configurations. The extremely relatively high speed at which a conventional impeller must be driven creates a large amount of friction and heat within the supercharger and its respective parts. These superchargers also tend to heat the air while it is being compressed thereby resulting in the output of hotter air by the supercharger. The heated air is less dense and is, therefore, less efficient than cooler air for increasing engine or drive source performance. Therefore, intercoolers have been used in conjunction with conventional superchargers to reduce the heat. Cooler air is desired since it is denser than hotter air. Therefore, cooler air does not have to be pressurized as much as hotter air in order to achieve the same results. Typically, conventional superchargers output higher pressurized air (i.e. ten pounds per square inch (10 psi)) because of the higher speeds at which the impeller is rotated, and the higher pressurized outputted air may cause stress and/or damage to the impeller and/or throttle components. Since the output of the supercharger is of relatively high pressure, flutter or pre-ignition of the engine or drive source may occur when the throttle is opened and closed due to the build up of reserved pressure in the output of the supercharger. Valves or waste gates have been provided to eliminate or reduce the build up of reserve air pressure Special electronic or computer control components or fuel management systems may be necessary to regulate the manner in which the engine or drive source responds to the air pressure fluctuations and/or air density fluctuations. Therefore, in overcoming the above problems and disadvantages of operating the supercharger at relatively high speed, it is highly desired and needed to provide a supercharger that outputs a lower constant pressuer of air and that operates at lower speeds.

Also, the gear driven (i.e. gear to gear configuration) overdrive assembly contained within the supercharger housing typically includes at least one relatively heavy, large gear in order to achieve the necessary gear up ratio. The heavy, large gear, therefore, increases the overall size and weight of the supercharger since the housing would have to be made large enough to house the heavy, large gear. Also, these gear driven overdrive assemblies typically use oil within the housing to lubricate the gears and bearings, and the oil further adds to the overall weight of the supercharger and the oil also retains heat within the supercharger.

Furthermore, the impeller and the meshing of the overdrive gears while rotating at extremely high speeds may cause a considerable amount of friction, heat, and noise to be produced. Since the impeller must be rotated at extremely high speeds and since the prior art drive components are relatively large and heavy, a substantial amount of inertia exists and must be overcome to drive and operate the supercharger and its respective components at extremely high speeds. Also, the existence of inertia within the drive configuration causes stresses and wear and tear on its respective components. The power losses related to overcoming the forces of inertia results in decreased engine performance. Therefore, it is desired and needed to provide a supercharger that has a drive configuration that reduces or eliminates frictional contact, heat, and inertia. Attempts have also been made to develop less noisy centrifugal superchargers by incorporating plastic gears within the overdrive gear assemblies. U.S. Pat. Nos. 5,423,304 and 5,425,345 disclose examples of such superchargers. These prior art patents are incorporated by reference herein. However, such superchargers that attempt in overcoming the noise problem still require extremely high impeller speeds and thereby create substantial gear friction which may result in premature gear failure. Therefore, it is also desired and needed to provide a supercharger that has a drive configuration that reduces or eliminates noise but does not contribute to gear friction and/or gear failure.

Therefore, the present invention discloses and provides an improved supercharger with a new impeller and improved drive components that overcome the above problems, disadvantages, and limitations of the prior art.

SUMMARY OF THE INVENTION

Set forth is a brief summary of the invention in order to solve the foregoing problems and achieve the foregoing and other objects, benefits, and advantages in accordance with the purposes of the present invention as embodied and broadly described herein.

It is an object of the invention to provide an improved supercharger.

It is another object of the invention to provide a new impeller for a supercharger.

It is a further object of the invention to provide an improved drive assembly for a supercharger.

It is still another object of the invention to provide an improved supercharger having a new impeller and an improved drive assembly.

It is another object of the invention to provide a supercharger that outputs a constant air pressure output over a wider range of drive source/engine operational speeds.

It is a further object of the invention to provide a supercharger that has highly precision made and/or high tolerance parts and components.

It is a still further object of the invention to provide an impeller design that is highly efficient in operation.

It is another object of the invention to provide a highly precision made impeller for a supercharger.

It is another object of the invention to provide a supercharger that uses a highly efficient impeller design that is operated at lower speeds.

It is still another object of the invention to provide a supercharger that results in less heat and friction when being operated.

It is a further object of the invention to provide a supercharger that outputs cool dense air to the engine or drive source.

It is still a further object of the invention to provide a supercharger that outputs cool dense air forced at a lower constant pressure to the engine or drive source.

It is another object of the invention to provide a supercharger that reduces or eliminates peripheral controls and parts such as valves, waste gates, and electronic controls.

It is still another object of the invention to provide a supercharger that is generally lighter in weight.

It is another object of the invention to provide a supercharger that is generally smaller in size.

It is a further object of the invention to provide a supercharger having components that have less inertia to overcome when being used.

It is another object of the invention to provide a drive assembly for a supercharger that produces less friction and heat.

It is still another object of the invention to provide a supercharger drive assembly having components that have less inertia to overcome when being used.

It is a further object of the invention to provide supercharger drive assembly components that are subjected to less stress and wear and tear and therefore operate more reliably over a longer period of time.

It is still a further object of the invention to provide a supercharger drive assembly that operates more quietly.

It is another object of the invention to provide a supercharger drive assembly that does not require the use of additional oil or lubricants.

It is a further object of the invention to provide a supercharger in which its components are subjected to less stress and wear and tear and therefore operate more reliably over a longer period of time.

The above objects and advantages of the invention are achieved by an improved supercharger that includes a new impeller, a volute chamber housing, a drive assembly, and a drive assembly mount. The new impeller has a body with a base and an air intake end, and it further has precision made air vanes attached to the body. The precision made air vanes each extends from the base to the air intake end, and the precision made air vanes have air sealing surfaces. The volute chamber housing has a precision made inner area. The precision made air vanes and the body are positioned within the volute chamber housing, and the air sealing surfaces of the precision made air vanes are precisely spaced relative to the precision made inner area. The drive assembly is coupled to the new impeller for driving and rotating the new impeller. The drive assembly is mounted to the drive assembly mount.

The new impeller of the improved supercharger further has an air foil attached to each of the precision made air vanes near the air intake end of the body. Each air foil creates air pressure differences to at least provide increased drawing of air into the volute chamber housing when the body is being rotated. The air foil is attached to each of the precision made air vanes near the air intake end of the body such that at least a portion of the air foil extends above the air intake end of the body so that at least a vortex action is created thereat. The precision made air vanes of the new impeller have thicker walls towards the air intake end of the body and thinner walls towards the base. Each of the precision made air vanes of the new impeller further comprises at least one groove located along each of the air sealing surfaces.

The drive assembly of the improved supercharger further has a drive source pulley adapted to couple to a drive source, an impeller pulley coupled to the new impeller, a drive belt coupled to the drive source pulley and the impeller pulley. The drive belt is driven by the drive source pulley to drive the impeller pulley. The drive source pulley, the impeller pulley, and the drive belt are placed within the drive assembly mount. Surfaces of the drive source pulley and the impeller pulley are cryogenically treated and hard anodized. The improved supercharger further has a hollow drive source shaft coupled to the drive source pulley and to the drive assembly mount and adapted to couple to the drive source and a hollow impeller shaft coupled to the impeller pulley and to the drive assembly mount. The improved supercharger also has at least one drive source bearing assembly coupled to the hollow drive source shaft and fitted to the drive assembly mount and at least one impeller bearing assembly coupled to the hollow impeller shaft and fitted to the drive assembly mount. The impeller bearing assembly has precision ceramic ball bearings.

The above objects and advantages of the invention are further achieved by a new impeller for a supercharger having a body with a base and an air intake end. The body is adapted to mount to a drive assembly of the supercharger. The drive assembly is able to drive and rotate the body and precision made air vanes attached to the body. The precision made air vanes each extends from the base to the air intake end, and the precision made air vanes and the body are able to be positioned within a volute chamber housing The precision made air vanes have air sealing surfaces that are precisely spaced relative to an inner area of the volute chamber of the supercharger.

The new impeller has an air foil attached to each of the precision made air vanes near the air intake end of the body. Each air foil creates air pressure differences to at least provide increased drawing of air into the volute chamber housing when the body is being rotated. The air foil is attached to each of the precision made air vanes near the air intake end of the body such that at least a portion of the air foil extends above the air intake end of the body so that at least a vortex action is created thereat. The precision made air vanes have thicker walls towards the air intake end of the body and thinner walls towards the base. Each of the precision made air vanes further have at least one groove located along each of the air sealing surfaces.

The above objects and advantages of the invention are also achieved by a method of making an improved supercharger. A new impeller having a body with a base and an air intake end and further having precision made air vanes attached to the body is provided. The precision made air vanes each extends from the base to the air intake end, and the precision made air vanes have air sealing surfaces. The new impeller is positioned in a precision made inner area of a volute chamber housing. The air sealing surfaces of the precision made air vanes are precisely spaced relative to the precision made inner area. A drive assembly is coupled to the new impeller for driving and rotating the new impeller. The drive assembly is coupled to a drive assembly mount.

An air foil is attached to each of the precision made air vanes near the air intake end of the body. Each air foil creates air pressure differences to at least provide increased drawing of air into the volute chamber housing when the body is being rotated. At least one groove is located along each of the air sealing surfaces. A drive source pulley is coupled to the drive assembly mount and adapted to couple to a drive source. An impeller pulley is coupled to the new impeller and to the drive assembly mount. A drive belt is coupled to the drive source pulley and the impeller pulley. The drive belt is driven by the drive source pulley to drive the impeller pulley. The air sealing surfaces of the precision made air vanes are precisely spaced at most five thousandths of an inch to the precision made inner area.

The preferred embodiments of the inventions are described below in the Figures and Detailed Description. Unless specifically noted, it is intended that the words and phrases in the specification and claims be given the ordinary and accustomed meaning to those of ordinary skill in the applicable art or arts. If any other meaning is intended, the specification will specifically state that a special meaning is being applied to a word or phrase. Likewise, the use of the words "function" or "means" in the Detailed Description is not intended to indicate a desire to invoke the special provisions of 35 U.S.C. Section 112, paragraph 6 to define the invention. To the contrary, if the provisions of 35 U.S.C. Section 112, paragraph 6, are sought to be invoked to define the inventions, the claims will specifically state the phrases "means for" or "step for" and a function, without also reciting in such phrases any structure, material, or act in support of the function. Even when the claims recite a "means for" or "step for" performing a function, if they also recite any structure, material or acts in support of that means of step, then the intention is not to invoke the provisions of 35 U.S.C. Section 112, paragraph 6. Moreover, even if the provisions of 35 U.S.C. Section 112, paragraph 6, are invoked to define the inventions, it is intended that the inventions not be limited only to the specific structure, material or acts that are described in the preferred embodiments, but in addition, include any and all structures, materials or acts that perform the claimed function, along with any and all known or later-developed equivalent structures, materials or acts for performing the claimed function.

DETAILED DESCRIPTION

The present invention is an improved mechanically driven centrifugal air compressor or supercharger 10 (hereafter collectively referred to as "supercharger") having a new impeller 20 and an improved drive assembly 40. The improved supercharger 10 is shown mounted to and driven by a drive source 5 (i.e. an internal combustion engine) in FIG. 1. The improved supercharger 10 forces more air into combustion chamber(s) of the engine to improve performance and efficiency.

Figure 2:
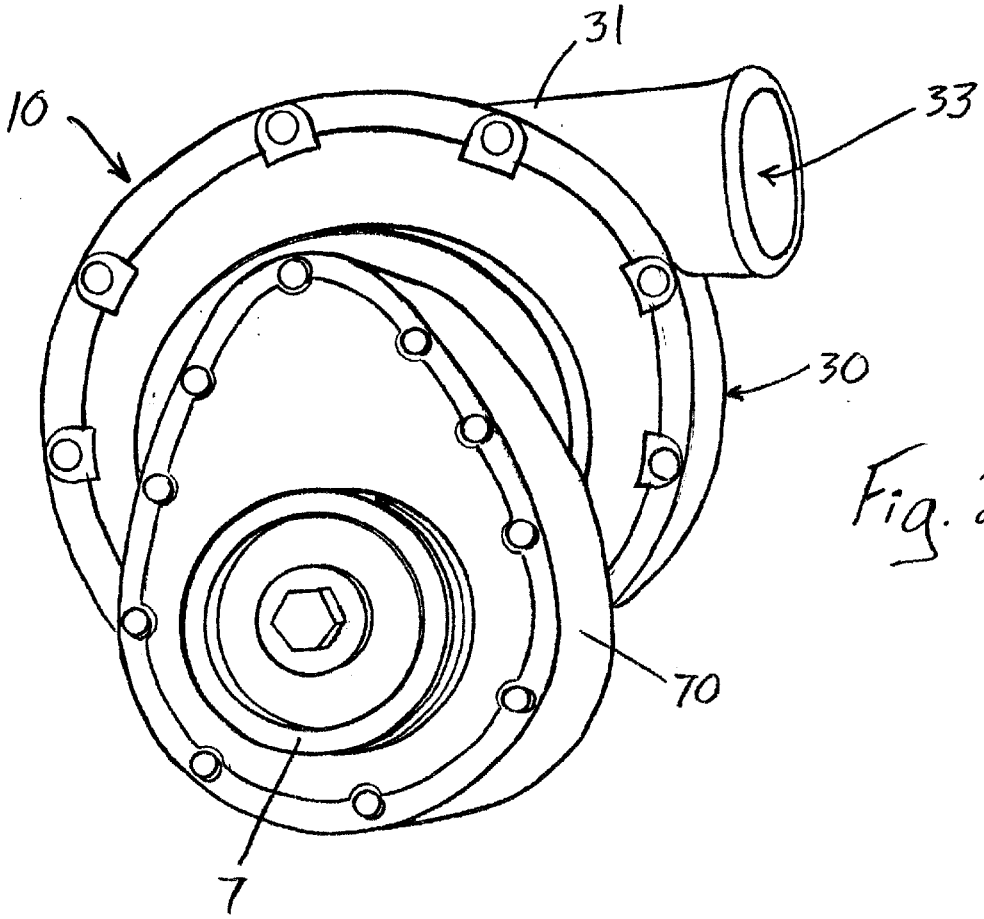
FIG. 2 is a front perspective view of the present invention supercharger.
Figure 3:
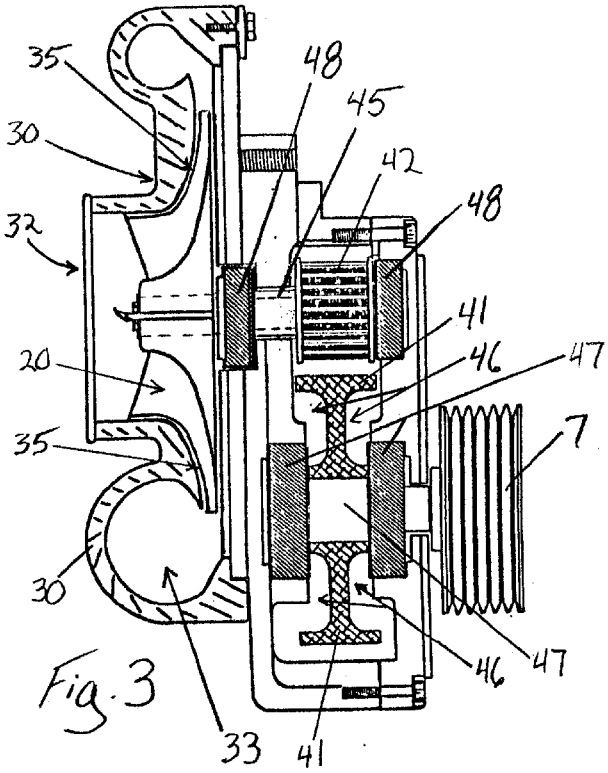
FIG. 3 is a side cross-sectional view of the present invention supercharger.
Figure 4:
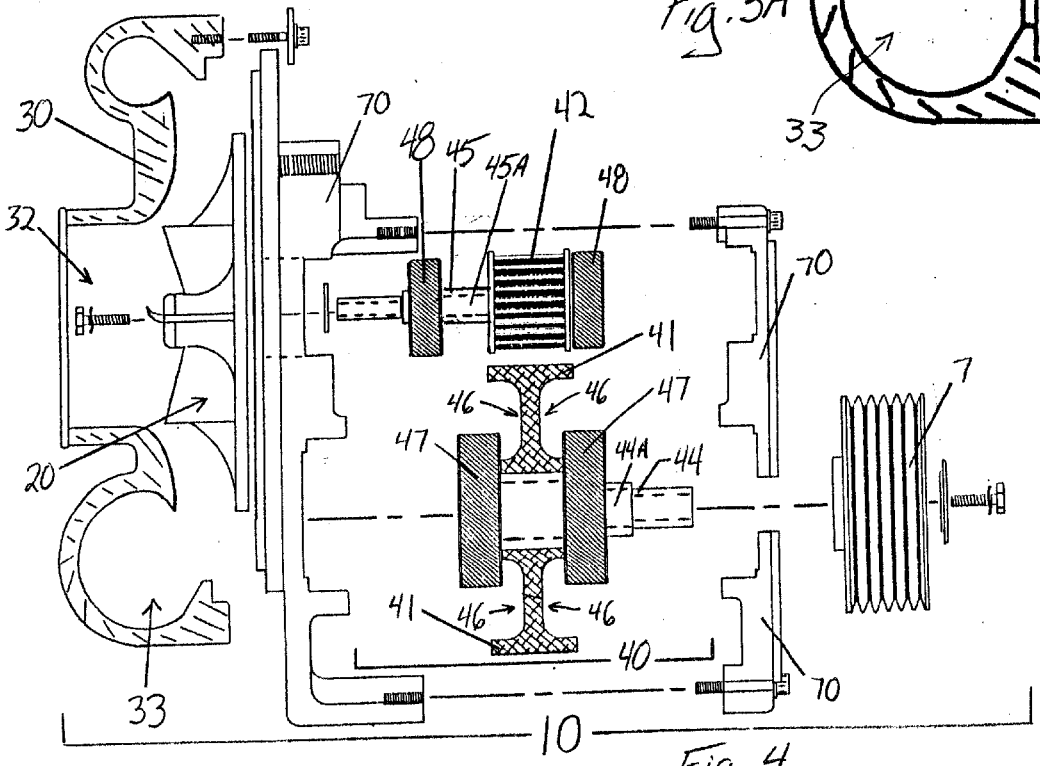
FIG. 4 is an exploded side cross-sectional view of the present invention supercharger.

FIGS. 2, 3, and 4 show various views of the improved supercharger 10 in its entirety. FIGS. 3 and 4 show the various parts of the improved supercharger 10. The supercharger 10 generally has a new impeller 20, a volute chamber housing 30, drive assembly 40, and a drive assembly mount 70.

FIGS. 5 to 8 show specific views of the new impeller 20. The new impeller 20 for supercharger 10 generally has a body 21 and precision made air vanes 22. The body 21 has a base 23 and an air intake end 24. The base 23 provides a wide support area while the air intake end 24 is a narrower portion at the top of the impeller 20. The base 23 is generally star-shaped and has a number of notched out areas 23A. The notched out areas 23A reduce the weight of the impeller and inertial forces related thereto. The surfaces 23B of the notched out areas 23A further create more air flow within the volute chamber housing 30 when the new impeller 20 is being driven and rotated. The body 21 is able to mount to the drive assembly 40 of the supercharger 10, and the drive assembly 40 is able to drive and rotate the body 21. Precision made air vanes 22 are attached to or made integral with the body 21 as shown in the figures. The precision made air vanes 22 each extends from the base 23 to the air intake end 24. Referring FIGS. 5 and 6, the outer edge surface of each precision made air vane 22 provides an air sealing surface 27 for the new impeller 20.

Figure 5:
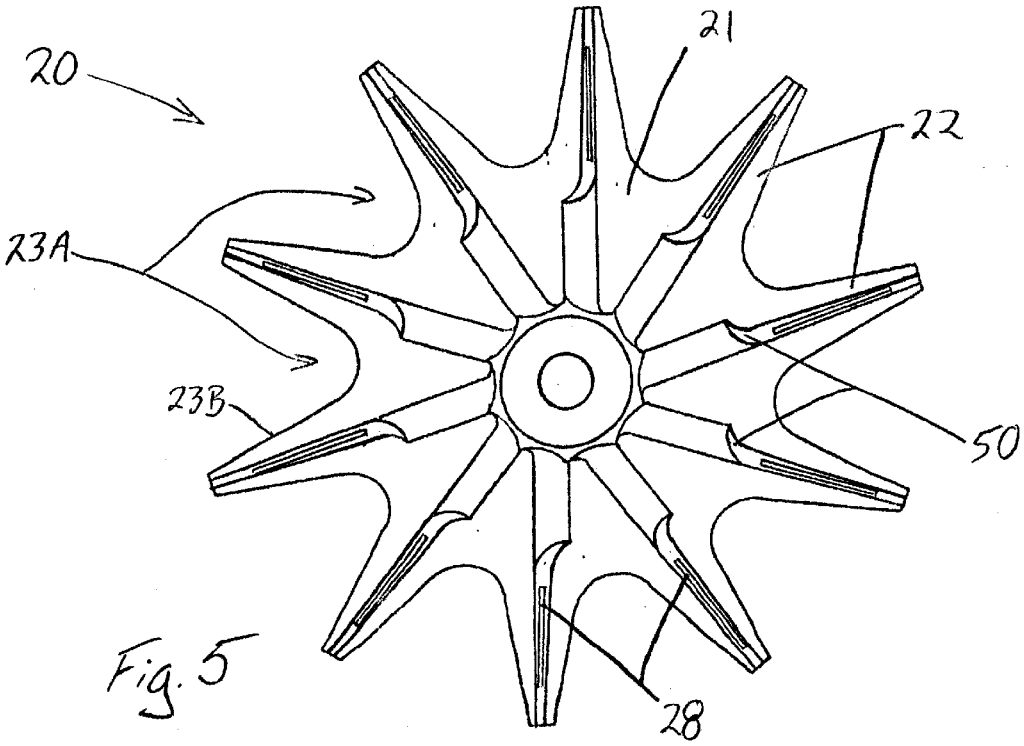
FIG. 5 is a top view of the new impeller for the present invention supercharger.
Figure 6:
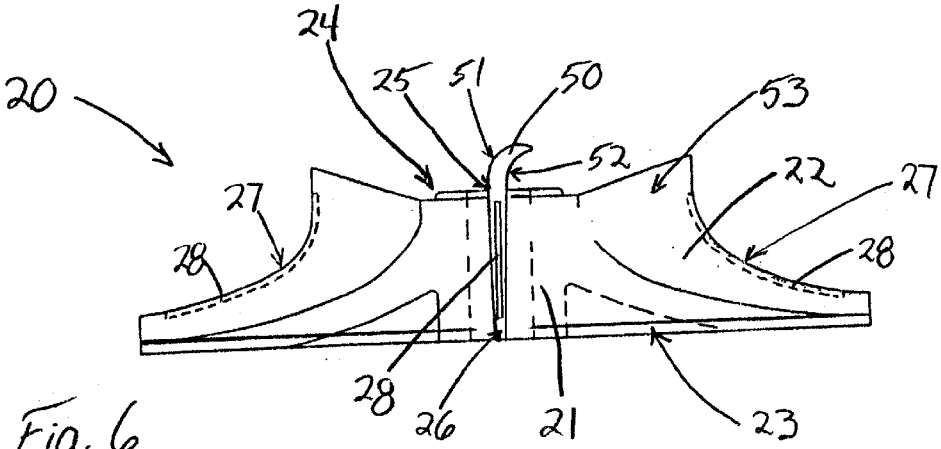
FIG. 6 is a side view of the new impeller of FIG. 5.
Figure 7:
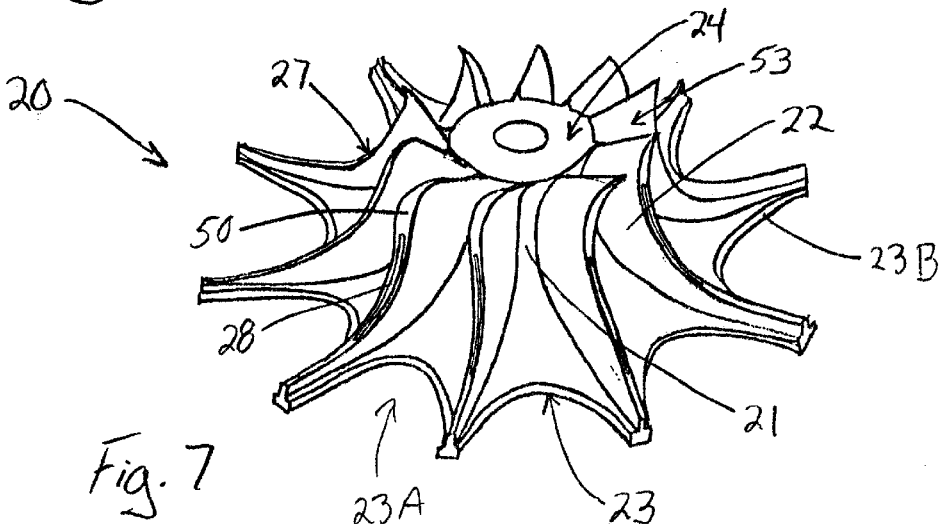
FIG. 7 is a perspective view of the new impeller of FIG. 5.

An air foil 50 is attached to or made integral with each of the precision made air vanes 22 near the air intake end 24 of the body 21. FIGS. 5, 6, and 7 show that the air foil 50 is a curved portion, and the curved portion creates air pressure differences between outer area 51 and inner area 52 of each air foil 50. The air pressure differences at least provide increased drawing of air into the volute chamber housing 30 when the body 21 is being rotated. At least a portion 53 of the air foil 50 extends above the air intake end 24 of the body 21 so that at least a vortex action is created thereat. The vortex action allows a greater volume of air to enter through the air intake opening 32 of the volute chamber housing 30 (i.e. see FIGS. 3 and 8) than a conventional prior art supercharger. Also, FIG. 6 shows that the precision made air vanes 22 are made to have thicker walls 25 towards the air intake end 24 of the body 21 and thinner walls 26 towards the base 23. Furthermore, FIGS. 5 and 6 show each precision made air vane 22 further having at least one groove 28 located along each air sealing surface 27. More details of the air sealing surface 27 and the at least one groove 28 will be provided later in the specification.

Figure 3A:
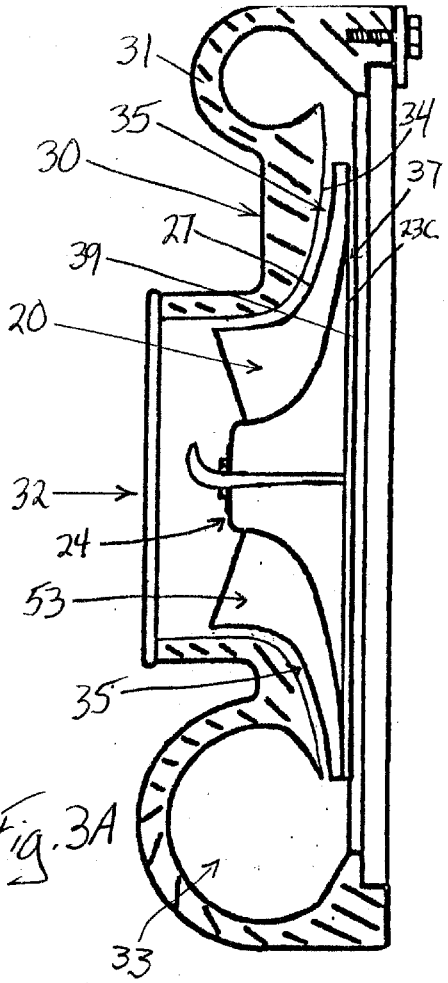
FIG. 3A is a detailed side cross-sectional view of the new impeller fitted to the precision made inner area of the volute chamber housing for the present invention supercharger.
Figure 8:
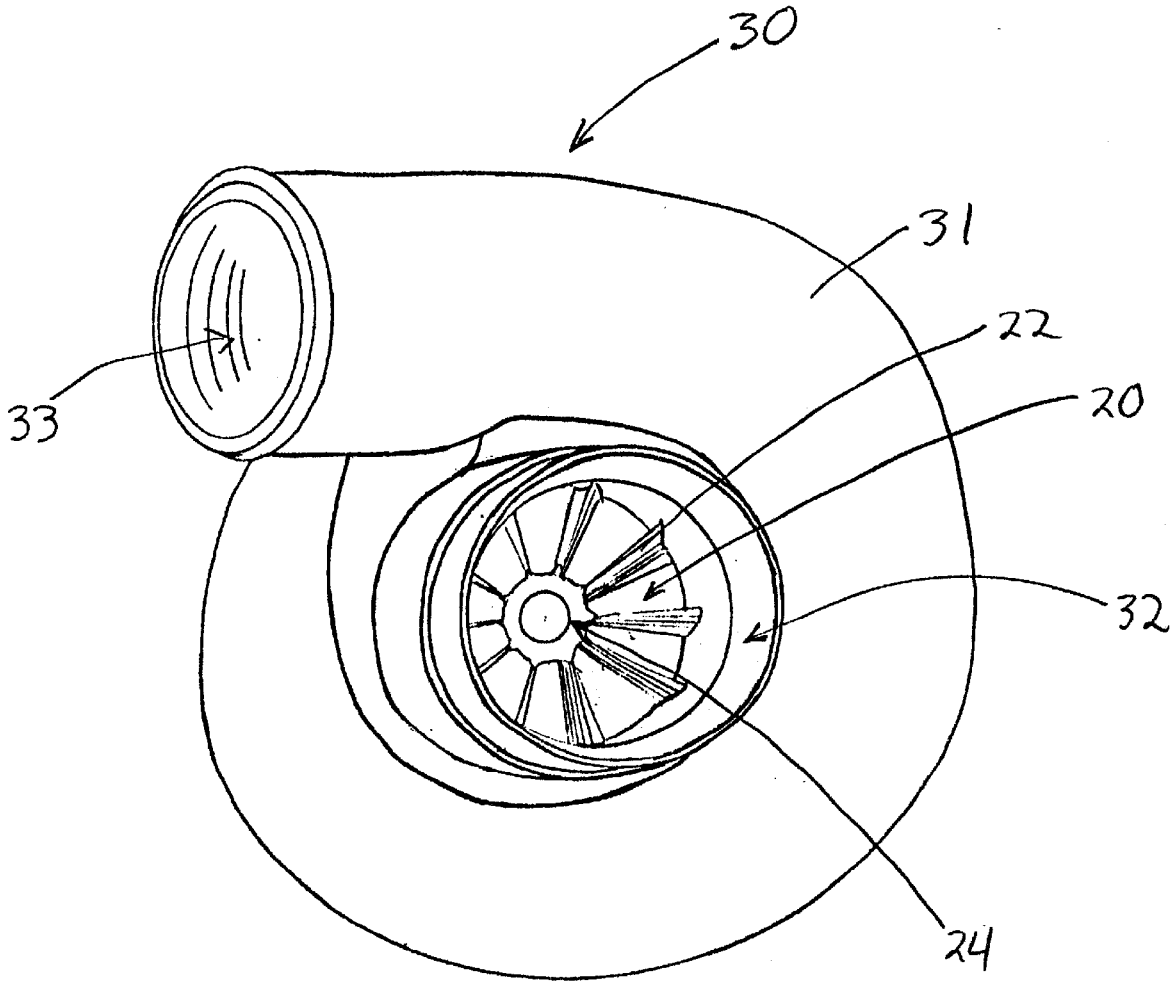
FIG. 8 is a rear perspective view of the volute chamber housing and the new impeller for the present invention supercharger.

The new impeller 20 is positioned within the volute chamber housing 30 (i.e. see FIGS. 3 and 8). Referring to FIGS. 3, 3A, 4, and 8, the volute chamber housing 30 generally has a chamber body 31, an air intake opening 32, an air output opening 33, and a precision made inner area 34. FIGS. 3, 3A, and 8 show the positioning of the precision made air vanes 22 and the body 21 relative to the volute chamber housing 30. The precision made air vanes 22 have air sealing surfaces 27 as discussed above. The air sealing surfaces 27 are precisely spaced a small gap distance 35 relative to the precision made inner area 34 of the volute chamber 30 as shown in FIG. 3A. Optimal performance of the supercharger 10 is achieved by precisely and as closely as possible spacing the air sealing surfaces 27 relative to the inner area 34, that is, the gap distance 35 is made as small and as precise as possible to provide precise air sealing therebetween. An air sealing effect is created at the gap distance 35 when the new impeller 20 is being driven and rotated. The at least one groove 28 on each of the air sealing surfaces 27 further creates air pockets which help to further provide an air sealing effect when the new impeller 20 is being driven and rotated. Also, an air sealing effect is created at the gap distance 37 between the base air sealing surface 23C of the base 23 and the volute chamber base surface 39 when the new impeller 20 is being driven and rotated. Precise air sealing results in less pressure losses for the supercharger 10. Therefore, the new impeller 20 is able to be rotated at a slower speed (i.e. lower RPMs) compared with conventional prior art impellers in order to generally achieve the same level as performance. The precise air sealing and the providing of air foils 50 on the vanes 22 causes the supercharger 10 to produce a flow of air at more of a constant pressure over a wider impeller speed (RPM) range than conventional superchargers. Conventional prior art superchargers typically provide an air sealing gap distance of fifteen to seventeen thousandths of an inch (0.015" to 0.017"). The present supercharger 10 is so precisely made and machined to provide air sealing gap distances 35 and 37 that are at most five thousandths of an inch (0.005") and eight thousandths of an inch (0.008") respectively.

Figure 9:
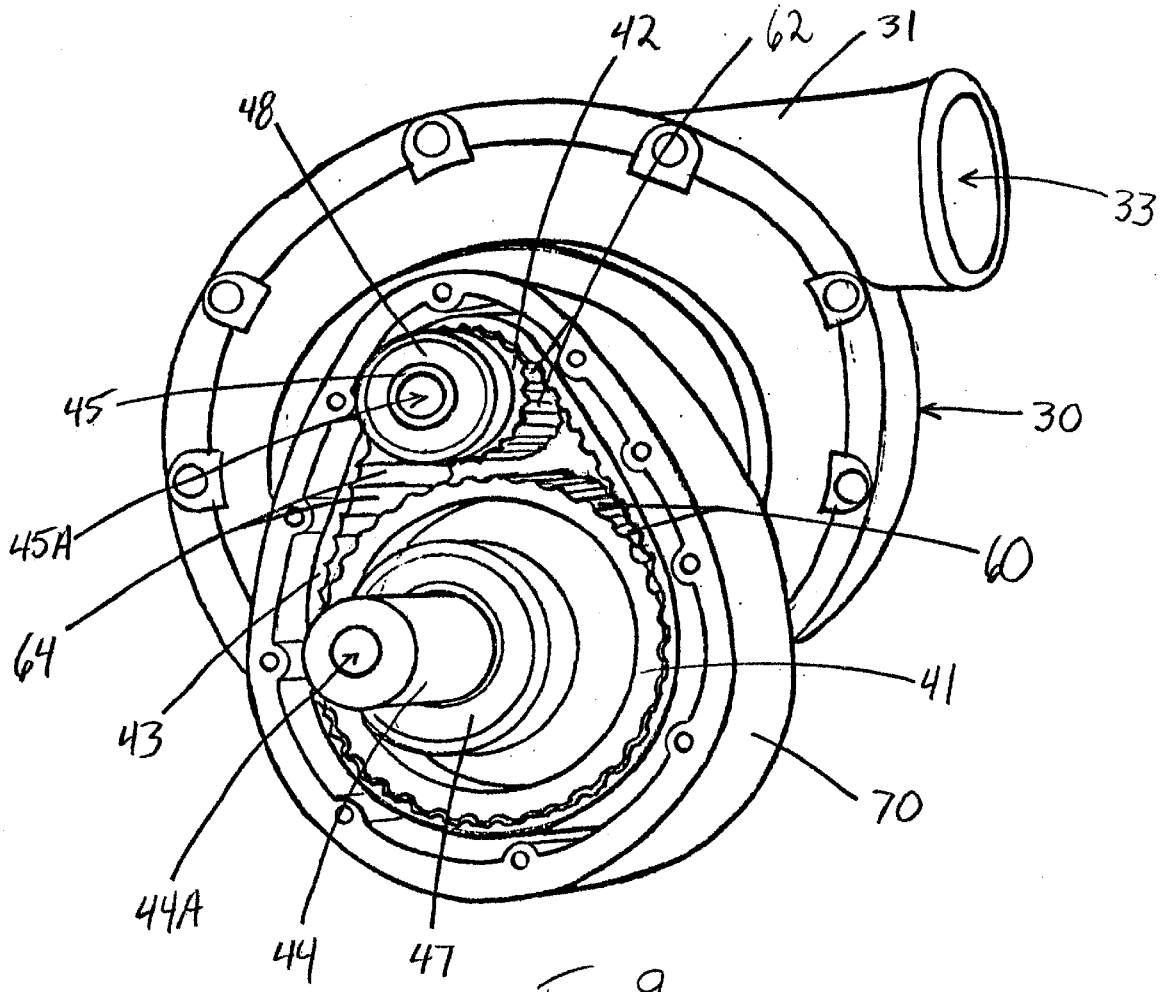
FIG. 9 is a front perspective view of the present invention supercharger showing the drive assembly components not including an idler.
Figure 10:
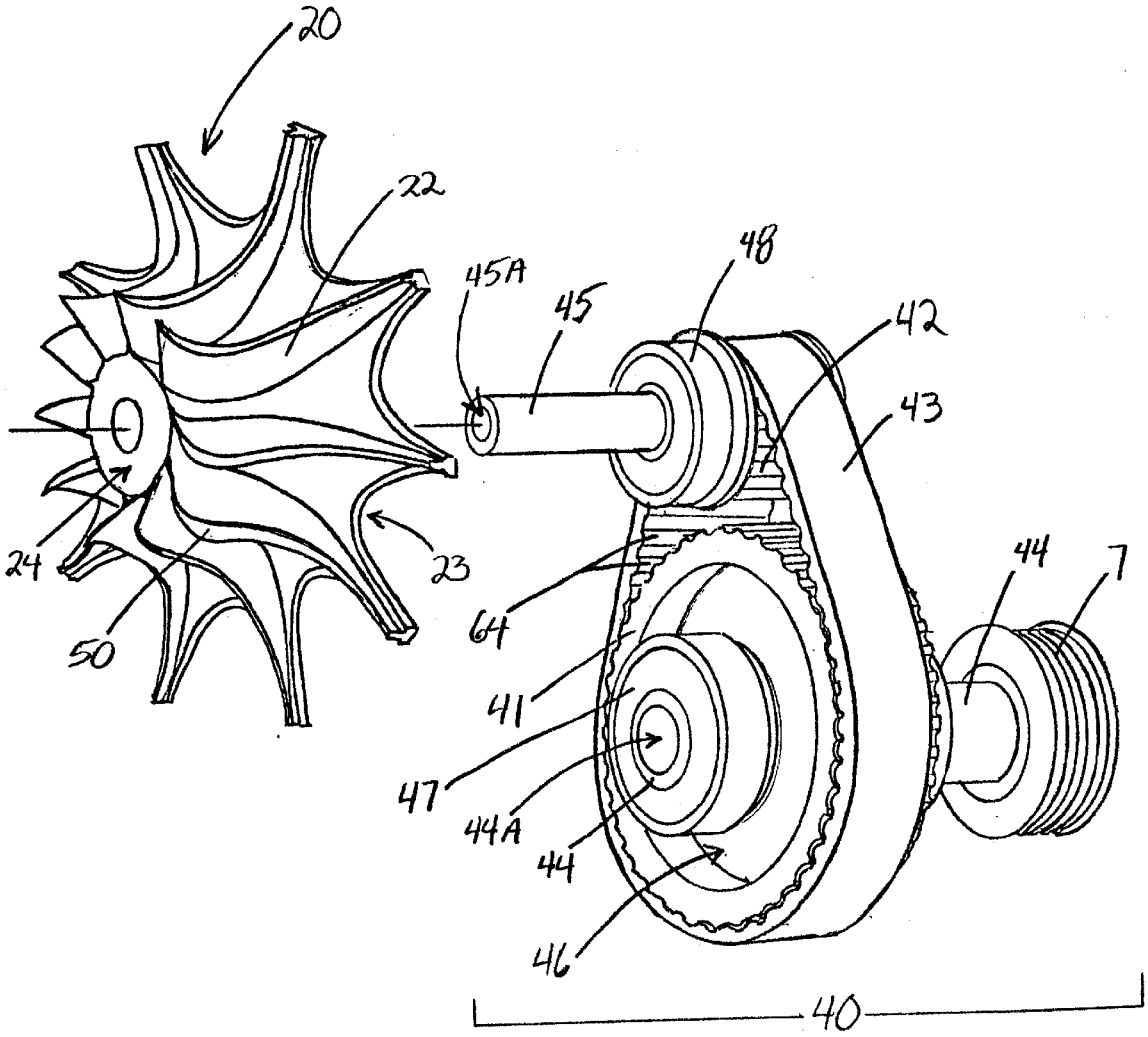
FIG. 10 is a perspective view of components for the improved drive assembly and the new impeller.

FIGS. 3, 4, 9, and 10 shows various views and parts of the drive assembly 40 for supercharger 10. FIG. 3 show the new impeller 20 coupled to the drive assembly 40. The drive assembly 40 drives and rotates the new impeller 20. The drive assembly 40 generally has a drive source pulley 41, an impeller pulley 42, and drive belt 43. The drive source pulley 41 is typically made from aluminum, and the impeller pulley 42 may be made from steel or aluminum The drive source pulley 41 is adapted to couple to a drive source/engine 5. The impeller pulley 42 is coupled to the new impeller 20. The drive belts 43 coupled to the drive source pulley 41 and the impeller pulley 42 so that the drive belt 43 is driven by the drive source pulley 41 and drive source/engine 5 to drive the impeller pulley 42. The drive source pulley 41 and the impeller pulley 42 are cylindrically shaped wheels with respective engaging teeth 60 and 62 around their perimeter edge as shown in FIG. 9. Also, the pulleys 41 and 42 may contain recessed areas 46 to reduce weight of these pulleys and inertial forces related thereto. FIGS. 9 and 10 show the drive belt 43 with corresponding teeth 64, and the drive belt is shown engaged to the pulleys 41 and 42 as shown in these figures. Also, the drive source pulley 41 is larger in diameter than the impeller pulley 42 in order to provide a gear up ratio (i.e. overdrive gear ratio). For example, the preferred gear up ratio for the present pulleys 41 and 42 is 3.050 to 1. However, the gear up ratio for conventional prior art superchargers is typically much greater than 3.050 to 1. Furthermore, surfaces of the drive source pulley 41 and the impeller pulley 42 are cryogenically treated and/or hard anodized to strengthen the pulleys and to provide a non-porous surface for each of these pulleys. The non-porous surfaces of pulleys 41 and 42 provide a very smooth surface resulting in less friction when engaged to the drive belt 43 thereby resulting in longer life for the drive belt 43.

Figure 1:
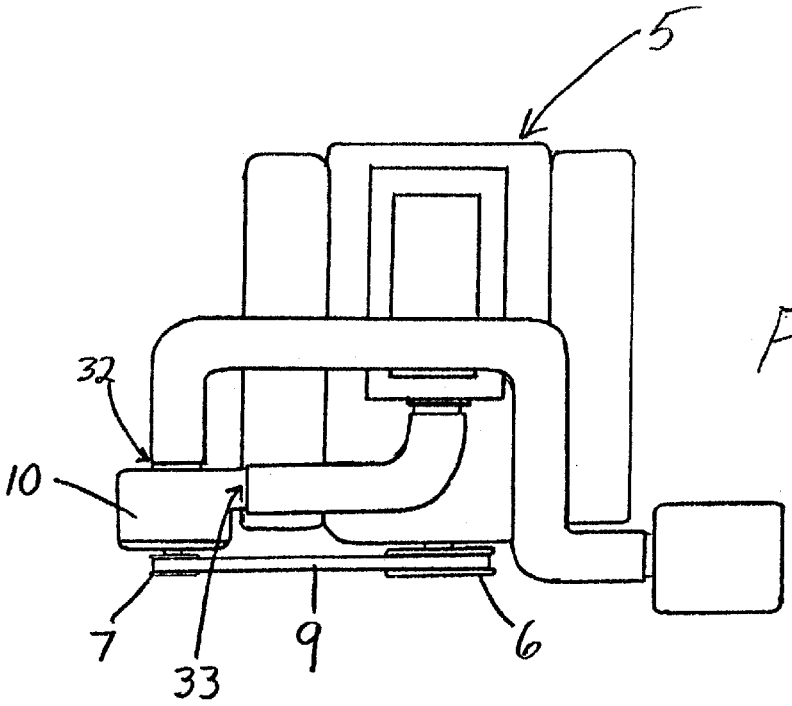
FIG. 1 is a top view of a drive source or engine with the present invention supercharger coupled thereto.

Referring to FIGS. 4, 9, and 10, the drive assembly 40 further comprises a drive source shaft 44 and an impeller shaft 45. Shafts 44 and 45 are both made hollow (i.e. having respective hollow areas 44A and 45A) in order to reduce weight of these parts and inertial forces related thereto (see FIG. 4). The hollow drive source shaft 44 is coupled to the drive source pulley 41 and to the drive assembly mount 70. The hollow impeller shaft 45 is coupled to the impeller pulley 42 and to the drive assembly mount 70. The drive source shaft 44 is coupled to a drive pulley 7. The drive source shaft 44 and drive pulley 7 are adapted to couple to the drive source/engine 5 (i.e. see FIG. 1) For example, FIG. 1 shows that the drive source or engine 5 has a motor pulley 6 and a motor belt 9. The motor belt 9 couples the motor pulley 6 to the drive pulley 7. The drive pulley 7 is thereby driven and rotated by the rotating motor belt 9 and motor pulley 6, and the drive pulley 7, in turn, drives the drive source pulley 41.

Referring to FIGS. 3 and 4, two drive source bearing assemblies 47 are coupled to the hollow drive source shaft 44 and fitted to the drive assembly mount 70. Also, in these figures, two impeller bearing assemblies 48 are coupled to the hollow impeller shaft 45 and fitted to the drive assembly mount 70. The impeller bearing assembly 48 closest to the new impeller 20 is positioned as closely and as precisely as possible to the new impeller 20 to provide further stability (i.e. see FIG. 3). The bearing assemblies 47 and the bearing assemblies 48 reduce friction between the respective rotating shafts 44 and 45 and the drive assembly mount 70. The bearing assemblies 47 and 48 are sealed bearings that do not require the use of oil or other lubricants for operation. The impeller shaft 45 generally rotates at a greater speed than the drive source shaft 44. Therefore, the impeller bearing assemblies 48 may have precision ceramic ball bearings in order to provide longer life and durability and to withstand frictional stress and heat.

The drive assembly 40 is placed within the drive assembly mount 70. FIGS. 3 and 9 show various drive assembly parts such as the drive source pulley 41, the impeller pulley 42, the drive belt 43, drive source shaft 44, impeller shaft 45, drive source bearing assembly 47, and impeller bearing assembly 48 coupled to and generally mounted within the drive assembly mount 70.

The new impeller 20 of FIG. 10 is placed on and coupled to the impeller shaft 45. The supercharger 10 generally operates by rotating the drive pulley 7. The drive pulley 7 drives and rotates the shaft 44, and shaft 44 drives and rotates the pulley 41. Pulley 41, in turn, causes drive belt 43 to rotatably drive pulley 42. Pulley 42 drives and rotates the shaft 45 which, in turn, rotates and drives the new impeller 20. Referring to FIGS. 3 and 8, when the supercharger 10 is in operation as just described, air is drawn by rotating the new impeller 20 into the air intake opening 32 and the volute chamber housing 30. The air becomes pressurized as the new impeller 20 in combination with the volute chamber 30 acts upon it. The air is forced out of the volute chamber 30 through the air output opening 33 under a constant pressure (i.e. greater than atmospheric pressure). The generally constant pressurized air is directed through duct 80 to the air intake of the engine or drive source 5.

The present supercharger 10 provides at least the key advantages of being able to operate at lower speeds (RPMs), provides a more constant pressure throughout a wider impeller and engine/drive source speed (RPM) range, and outputs cooler and more dense air than conventional prior art superchargers. Furthermore, the present supercharger 10 is able to be made smaller and lighter because it does not require use of larger and heavier gears and is able to be quieter since there are no direct gear to gear contact. The present supercharger 10 is also cleaner to operate since it does not require the use of additional oils or other such lubricants in order to operate. Overall, since the present supercharger 10 is operated at lower speeds (RPMs), then less stress and wear and tear is placed on its parts and the supercharger 10 does not generate as much heat and is able to operate at lower temperatures than conventional superchargers.

The preferred embodiment of the invention is described above in the Figures and Detailed Description. Unless specifically noted, it is the intention of the inventor that the words and phrases in the specification and claims be given the ordinary and accustomed meanings to those of ordinary skill in the applicable art(s). The foregoing description of a preferred embodiment and best mode of the invention known to applicant at the time of filing the application has been presented for the purposes of illustration and description. It is not intended to be exhaustive or to limit the invention to the precise form disclosed, and many modifications and variations are possible in the light of the above teaching. The embodiment was chosen and described in order to best explain the principles of the invention and its practical application and to enable others skilled in the art to best utilize the invention in various embodiments and with various modifications as are suited to the particular use contemplated.

What is claimed is:

1. A new impeller for a supercharger comprising:

a body having a base and an air intake end wherein the body is adapted to mount to a drive assembly of the supercharger and the drive assembly is able to drive and rotate the body, and precision made air vanes attached to the body wherein the precision made air vanes each extends from the base to the air intake end and wherein the precision made air vanes and the body are able to be positioned within a volute chamber housing and wherein the precision made air vanes have air sealing surfaces that are precisely spaced relative to an inner area of the volute chamber of the supercharger and wherein each of the precision made air vanes further comprises at least one groove that is located substantially parallel to each of the sealing surfaces.

2. The new impeller according claim 1 further comprising:

an air foil attached to each of the precision made air vanes near the air intake end of the body wherein each air foil creates air pressure differences to at least provide increased drawing of air into the volute chamber housing when the body is being rotated.

3. The new impeller according to claim 2 wherein the air foil is attached to each of the precision made air vanes near the air intake end of the body such that at least a portion of the air foil extends above the air intake end of the body so that at least a vortex action is created thereat.

4. The new impeller according to claim 1 wherein the precision made air vanes have thicker walls towards the air intake end of the body and thinner walls towards the base.

5. An improved supercharger comprising:

a new impeller having a body with a base and an air intake end and further having precision made air vanes attached to the body wherein the precision made air vanes each extend from the base to the air intake end and wherein the precision made air vanes have air sealing surfaces and wherein each of the precision made air vanes of the new impeller further comprises at least one groove located along each of the air sealing surfaces, a volute chamber housing having a precision made inner area wherein the precision made air vanes and the body are positioned within the volute chamber housing and wherein the air sealing surface of the precision made air vanes are precisely spaced relative to the precision made inner area, a drive assembly coupled to the new impeller for driving and rotating the new impeller, and a drive assembly mount to which the drive assembly is coupled.

6. The improved supercharger according claim 5 wherein the new impeller further comprises:

an air foil attached to each of the precision made air vanes near the air intake end of the body wherein each air foil creates air pressure differences to at least provide increased drawing of air into the volute chamber housing when the body is being rotated.

7. The improved supercharger according to claim 6 wherein the air foil is attached to each of the precision made air vanes near the air intake end of the body such that at least a portion of the air foil extends above the air intake end of the body so that at least a vortex action is created thereat.

8. The improved supercharger according to claim 5 wherein the precision made air vanes of the new impeller have thicker walls towards the air intake end of the body and thinner walls towards the base.

9. The improved supercharger according to claim 5 wherein the drive assembly further comprises:

a drive source pulley adapted to couple to a drive source, an impeller pulley coupled to the new impeller, a drive belt coupled to the drive source pulley and the impeller pulley wherein the drive belt is driven by the drive source pulley to drive the impeller pulley, and wherein the drive source pulley, the impeller pulley, and the drive belt are placed within the drive assembly mount.

10. The improved supercharger according to claim 9 wherein surfaces of the drive source pulley and the impeller pulley are cryogenically treated.

11. The improved supercharger according to claim 9 further comprising:

a hollow drive source shaft coupled to the drive source pulley and to the drive assembly mount and adapted to couple to the drive source, and a hollow impeller shaft coupled to the impeller pulley and to the drive assembly mount.

12. The improved supercharger according to clam 11 further comprising:

at least one drive source bearing assembly coupled to the hollow drive source shaft and fitted to the drive assembly mount, and at least one impeller bearing assembly coupled to the hollow impeller shaft and fitted to the drive assembly mount.

13. The improved supercharger according to claim 12 wherein the at least one impeller bearing assembly have precision ceramic ball bearings.

14. A method of making an improved supercharger comprising the steps of:

providing a new impeller having a body with a base and an air intake end and further having precision made air vanes attached to the body wherein the precision made air vanes each extends from the base to the air intake end and wherein the precision made air vanes have air sealing surfaces, locating at least one groove substantially parallel to each of the air sealing surfaces, positioning the new impeller in a volute chamber housing, precisely spacing the air sealing surfaces of the precision made air vanes relative to the precision made inner area, coupling a drive assembly to the new impeller for driving and rotating the new impeller, and coupling the drive assembly to a drive assembly mount.

15. The method of making an improved supercharger according claim 14 wherein the providing a new impeller step further comprises the step of:

attaching an air foil to each of the precision made air vanes near the air intake end of the body wherein each air foil creates air pressure differences to at least provide increased drawing of air into the volute chamber housing when the body is being rotated.

16. The method of making an improved supercharger according to claim 14 wherein the coupling a drive assembly step further comprises the steps of:

providing a drive source pulley coupled to the drive assembly mount and adapted to couple to a drive source, coupling an impeller pulley to the new impeller and to the drive assembly mount, and coupling a drive belt to the drive source pulley and the impeller pulley wherein the drive belt is driven by the drive source pulley to drive the impeller pulley.

17. The method of making an improved supercharger according to claim 14 wherein the precisely spacing step further comprises the step of:

precisely spacing the air sealing surfaces of the precision made air vanes at most five thousandths of an inch to the precision made inner area.

18. The improved supercharger according to claim 10 wherein the surfaces of the drive source pulley are also hard anodized.

19. The improved supercharger according to claim 10 wherein the surfaces of the impeller pulley are also hard anodized.

* * * * *